United States Patent [19]

Eber

[11] 3,977,853

[45] Aug. 31, 1976

[54] REFRIGERATOR WITH AN ABSORPTION REFRIGERATING APPARATUS

[75] Inventor: Nicolas Eber, Unterengstringen, Switzerland

[73] Assignee: Sarlab Aktiengesellschaft, Zurich, Switzerland

[22] Filed: Sept. 9, 1974

[21] Appl. No.: 504,126

[30] Foreign Application Priority Data

Sept. 11, 1973 Sweden ..... 7312311

[52] U.S. Cl. ..... 62/491; 62/493; 62/522

[51] Int. Cl.[2] ..... F25B 15/10

[58] Field of Search ..... 62/490, 491, 493, 522, 62/443

[56] References Cited

UNITED STATES PATENTS

| | | | |
|---|---|---|---|
| 2,048,355 | 7/1936 | Särnmark | 62/492 |
| 2,130,331 | 9/1938 | Dennedy | 62/522 |
| 2,152,269 | 3/1939 | Nelson | 62/493 X |
| 2,242,281 | 5/1941 | Algren et al. | 62/493 |
| 2,770,108 | 11/1966 | Backstrom | 62/443 |
| 2,855,766 | 10/1958 | Elfuing et al. | 62/493 |
| 3,134,245 | 5/1964 | Phillips et al. | 62/490 |
| 3,820,356 | 6/1974 | Stierlin | 62/493 X |

FOREIGN PATENTS OR APPLICATIONS

| | | | |
|---|---|---|---|
| 486,268 | 6/1938 | United Kingdom | 62/492 |

*Primary Examiner*—William F. O'Dea
*Assistant Examiner*—Ronald C. Capossela
*Attorney, Agent, or Firm*—Alfred E. Miller

[57] ABSTRACT

A simplified refrigeration apparatus in which the evaporator part includes a straight, generally horizontal pipe system that is connected to a linear continuation forming a gas heat exchanger. The assembly is inserted in the cooling chamber of a refrigerator through an opening in the insulated refrigerator cabinet. The gas heat exchanger is positioned within said insulation while the evaporator part is projected into the interior of the cooling chamber. The assembly permits the easy removal from the refrigerator cabinet, when desired, and is of compact construction lending itself to requirements of a small refrigerator.

9 Claims, 2 Drawing Figures

REFRIGERATOR WITH AN ABSORPTION REFRIGERATING APPARATUS

BACKGROUND OF THE INVENTION

The evaporator in an absorption type refrigeration appartus operating with inert gas is located in the cooling space of the refrigerator. In this space the heat transfer required for cooling is achieved by operation of the evaporator, which generally is provided with cooling fins. The evaporator assembly is placed in the refrigerator cabinet either by inserting the evaporator assembly through a window cut in the rear wall of the refrigerator cabinet or by mounting directly in the window itself. In either case the window must be sealed tightly by heat insulation after the evaporator assembly has been inserted in the refrigerator cabinet. Furthermore, the gas heat exchanger of the refrigerating apparatus which connects the cold evaporator part to the warmer parts of the apparatus must be heat-insulated both from the cooled space and from the ambient. Therefore, the gas heat exchanger is generally mounted in the window in the rear wall of the refrigerator apparatus.

When foamed plastic resins, such as polyurethane, are used as insulating material for a refrigerator two separate foaming operations are required. One foaming operation forms the heat insulation for the refrigerator walls and after the refrigerating apparatus, as described above, has been mounted a second foaming operation is initiated in order to seal the window and heat insulate the parts therein, for example the gas heat exchanger. The second foaming operation can be performed in situ or outside of the refrigerator using a mold that will produce an insulation configuration that will fit accurately in the window in the rear wall of the refrigerator after the refrigerating apparatus is installed therethrough.

A prior art procedure has simplified this process by utilizing a single foaming operation. This latter procedure, however, has the disadvantage, that after mounting the refrigerating apparatus in the cabinet and sealing the same, the refrigerating apparatus cannot be readily removed from the cabinet. Furthermore, there is the danger that part of the cabinet or apparatus may be damaged upon the removal.

It is an object of the present invention to simplify the manufacture of a refrigerator and to construct a refrigerator in such a manner that the refrigerating apparatus can be removed from the cabinet without damaging the cabinet and the apparatus itself.

Another object of the present invention is to provide a compact refrigerator in which is the refrigerating apparatus is easily mounted and removed from the refrigerator cabinet. The refrigerator apparatus is compact since the evaporator system is a pipe system extending linearly and horizontally while the gas heat exchanger is a straight line continuation thereof. Thus, the entire assembly is generally on a single plane with the evaporator located in the cooling chamber and th gas heat exchanger in an opening in the rear wall insulation of the refrigerator cabinet. Moreover, an evaporator plate of heat conductive material, such as aluminum, is provided with a suitable cylindrical opening which fits over and is secured to the evaporator pipe positioned inside the refrigerator cabinet. The evaporator plate functions as a support for ice trays set above and is provided with cooling fins on the underside of the evaporator plate. Another object of the present invention is to improve the heat conduction between the evaporator pipe and the part of the evaporator plate surrounding said pipe by using a heat-conductive joining material.

The invention will now be described with reference to the accompanying drawings, in which:

FIG. 1 is a vertical cross-sectional view through the upper part of a refrigerator showing the refrigerating apparatus, all as constructed in accordance with the teachings of the present invention, and FIG. 2 is a perspective view of the upper part of the refrigerator shown in FIG. 1, with the door removed for purposes of clarity.

DESCRIPTION OF THE PREFERRED EMBODIMENT

Figure 1:
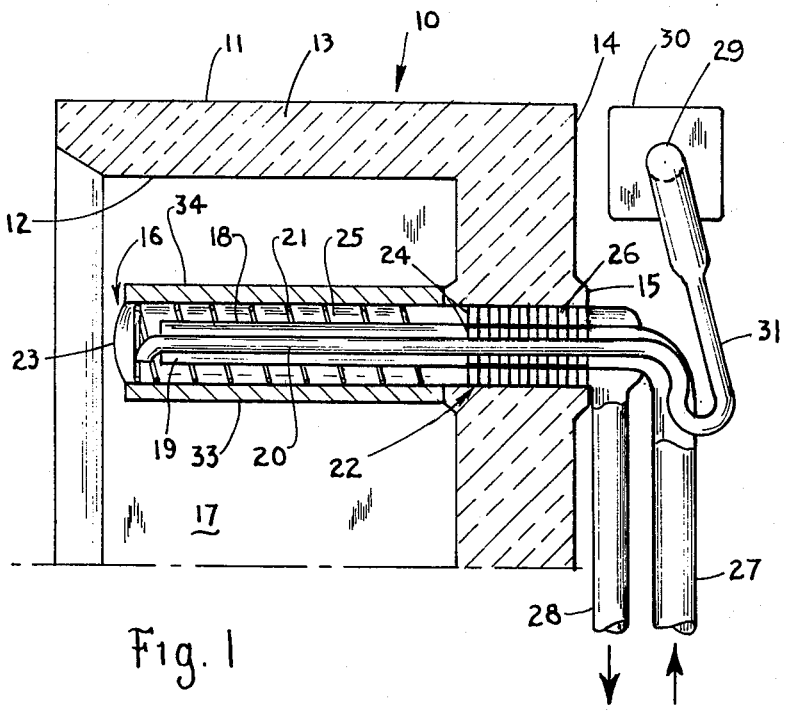

Referring to FIG. 1, a refrigerator 10 is shown comprising an outer cabinet 11 and an inner lining 12 which is separated by heat insulation 13. The latter is provided with a rear wall 14 and an opening 15 of circular cross-section. The present refrigerator is an absorption refrigeratin apparatus of the inert gas type which is usually charged with ammonia, water and hydrogen as a working medium. This refrigerator is well known and need not be further described, and only those parts of the refrigerator which are relevant are shown and described herein.

As seen in FIG. 1, the evaporator 16 projects through the circular opening 15 and into the interior of the cooling chamber 17. The evaporator pipe arrangement comprises an outer pipe 18, an intermediate pipe 19 which conducts gas that is weak in refrigerant and an inner conduit or pipe 20 which conducts the liquid refrigerant. A wire helix 21 is shown positioned within the outer pipe 18 and abutting the inner wall thereof. This wire helix functions to improve the moistening of the wall of pipe 18 by means of refrigerant condensate.

Referring again to FIG. 1, the weak gas and refrigerant condensate, both having been precooled in a gas heat exchanger 22, are introduced into the outer pipe 18 at the front end of the evaporator. The weak gas and the refrigerant condensate pass in parallel flow through the pipe 18 to the gas heat exchanger 22. However, the refrigerant condensate is evaporated under the influence of heat supplied to the gas flow from the outside of the pipe. Thus, the weak gas and the refrigerant condensate which passes in counterflow to the cold rich gas are cooled in the gas heat exchanger 22. It should be noted that the gas heat exchanger is heat insulated from the ambient since it is located within the insulation 13 of the refrigerator in the opening 15 through the rear wall 14 of the refrigerator cabinet.

The tabs or pin-like elements 24 of the gas heat exchanger are located in the flow passage 25 for the rich gas and the flow passage 26 for the weak gas. The tabs result in both surface enlargement and air turbulence. The weak gas flows from an absorber (not shown) through a conduit 27 to the heat exchanger 22. The weak gas then flows through the heat exchanger. On the other hand, the rich gas flows through a conduit 28 to the absorber.

In the present system the refrigerant condensate is formed in a condenser 29 having cooling fins 30, in which only one is shown in FIG. 1. The condensate is conveyed through a conduit 31 into a gas heat exchanger 22, and thereafter by the inner conduit 20 in the evaporator 16 to the front end 23 of the evaporator.

Figure 2:
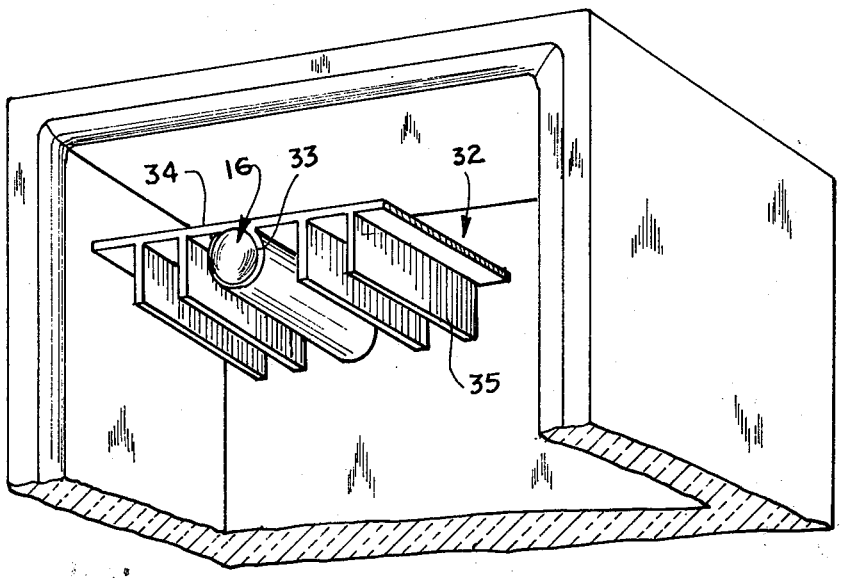

Referring now to FIG. 2, the evaporator plate 32 is illustrated which is preferably fabricated of extruded aluminum, or any other material having a high heat-conducting capability. A cylindrical element is shown having a tubular opening 33 in which evaporator pipe 16 is inserted. The top part 34 of the evaporator 32 functions to receive ice trays for freezing ice cubes. The downwardly extending fins 35 function to enlarge the cooled area in the chamber 17.

When the refrigerator 10 is assembled, the cylinder element of the evaporator plate 32 has the evaporator pipe 16 press-fitted therein and a heat-conductive substance is interposed between the outside of the pipe 16 and the inside of the cylindrical element in order to improve the heat contact between the evaporator pipe and the evaporator plate.

It should be observed that the length of the evaporator assembly is aobut 20 cm. for small refrigerators and the length of the connected gas heat exchanger in the present construction is no more than 10 cms. Since the heat exchanger is so small it can be actually built in the rear wall 14 of the refrigerator. Because of such short gas heat exchangers there may be considerable loss of cold by heat conduction in the length direction of heat exchanger parts. Accordingly, it is proposed to make the heat exchanger with a pipe wall of relatively small thickness and of a material with low heat-conducting capability. Furthermore, since in absorption refrigerating apparatus ammonia is used as a refrigerant and water as an absorption medium, austenite chrome nickel steel is utilized because of the danger of corrosion. Since this material is used in the outer pipe 18 of the evaporator, it is not necessary to treat the pipe surfaces in order to protect the pipe from corrosion.

It is also within the scope of the present invention to construct the evaporator pipe 16 and its corresponding opening 15 in the insulation 13 of the refrigerator 10 in a non-circulation configuration, preferably rectangular.

The present cooling unit of the invention not only provides ease of assembly, but its material cost and requirements are considerably lowr than previously known cooling units of the same size and performance. Furthermore, the weight of the unit is considerably reduced from other cooling units which is of significant importance with respect to mobile refrigerators.

What I claim is:

1. In an absorption refrigeration apparatus operating with an inert gas and having an insulated cabinet forming a cooling chamber and an evaporator system, said cabinet being provided with at least two openings therein, the improvement comprising: an evaporator pipe extending generally linearly and horizontally in said cooling chamber, and a gas heat exchanger being co-axial and linearly co-extensive with said evaporator pipe, said heat exchanger having a plurality of spaced, pin-like elements at least partially surrounding a portion of said evaporator pipe located in said refrigerator insulation, said evaporator pipe being inserted through one of said openings in the cabinet and into said cooling chamber.

2. The combination as claimed in claim 1 further comprising a structure of heat conducting material that is heat conductively connected to said evaporator pipe, said structure forming a surface enlarging means for cooling the air in said cooled space and for providing a shelf for supporting articles.

3. The combination as claimed in claim 2 further comprising a heat conductive substance interposed betwen the outside of said evaporator pipe and the surrounding part of said heat conducting structure.

4. The combination as claimed in claim 1 wherein said pin-like elements are heat conductive members of relatively small cross-section that extend in a direction substantially perpendicular to the main gas flow and affect said flow.

5. The combination as claimed in claim 1 wherein said evaporator system is provided with an outer pipe forming the outer casing for said system, said gas heat exchanger and outer pipe being constituted of a metallic material of low heat conducting capability.

6. The combination as claimed in claim 5 wherein said metallic material is of austenite chrome nickel steel.

7. The combination as claimed in claim 5 wherein said evaporator system further comprises a wire helix abutting said outer pipe whereby the pipe wall is moistened by refrigerant.

8. The combination as claimed in claim 1 wherein said evaporator pipe and said one opening in the cabinet are circular in cross-section.

9. The combination as claimed in claim 1 wherein said gas heat exchanger further includes pipes which are at least partly constituted of a material with a low heat conducting capability compared with the material of the rest of the absorption refrigeration apparatus.

* * * * *